US010008306B1

(12) United States Patent
Wu

(10) Patent No.: US 10,008,306 B1
(45) Date of Patent: Jun. 26, 2018

(54) CABLE WITH DEMAGNETIZING LAYER OF GRAPHENE

(71) Applicant: Li-Fen Wu, Yuanlin (TW)

(72) Inventor: Li-Fen Wu, Yuanlin (TW)

( * ) Notice: Subject to any disclaimer, the term of this patent is extended or adjusted under 35 U.S.C. 154(b) by 0 days. days.

(21) Appl. No.: 15/831,582

(22) Filed: Dec. 5, 2017

(51) Int. Cl.
*H01B 11/06* (2006.01)
*H01B 11/10* (2006.01)
*H01B 13/22* (2006.01)

(52) U.S. Cl.
CPC ..... *H01B 11/06* (2013.01); *H01B 11/10* (2013.01); *H01B 13/225* (2013.01)

(58) Field of Classification Search
CPC ..... H01B 11/06; H01B 11/10; H01B 13/225
See application file for complete search history.

(56) References Cited

U.S. PATENT DOCUMENTS

2014/0079360 A1* 3/2014 Winarski ..... G02B 6/262 385/102
2015/0125122 A1* 5/2015 Winarski ..... G02B 6/25 385/123
2016/0172805 A1* 6/2016 Nawrocki ..... H01R 25/00 439/638

* cited by examiner

*Primary Examiner* — Hoa C Nguyen
*Assistant Examiner* — Amol Patel
(74) *Attorney, Agent, or Firm* — Alan D. Kamrath; Kamrath IP Lawfirm, P.A.

(57) ABSTRACT

A cable includes a transmission cord having two connecting terminals formed on two opposite ends thereof, two connectors respectively mounted on the two connecting terminals of the transmission cord, two end caps mounted on the transmission cord and respectively connected with the two connectors, and at least one demagnetizing layer mounted on the two connectors and received in the two end caps. The transmission cord includes a conducting wire, an insulating layer wrapped around the conducting wire to insulate the conducting wire, and a protective layer wrapped around an outer face of the transmission cord. The at least one demagnetizing layer is made of graphene to prevent the electromagnetic waves of the ambient environment from interfering with the signal transmission of the transmission cord.

14 Claims, 6 Drawing Sheets

CABLE WITH DEMAGNETIZING LAYER OF GRAPHENE

BACKGROUND OF THE INVENTION

1. Field of the Invention

The present invention relates to a cable and, more particularly, to a cable for a sound reproducing system.

2. Description of the Related Art

A cable is used in house appliances, instruments, electronic tools, automation equipment or the like, to function as a signal line for transmission of signals. However, the signals are easily interrupted by noises, such as external electromagnetic waves, during transmission of the signals (especially high frequency signals), so that the signals are unsteady due to the noise interference. When the cable is used in a sound reproducing system, the cable is more easily affected by the noise interference. The sound reproducing system includes many transmission cables whose noises interfere with each other, so that the audio signals are interrupted, and the sound transmitted by the transmission cables is unsteady. A metallic film (or mesh shielding layer) is coated on the transmission cable and is grounded to isolate the noise interference efficiently. Alternatively, an anti-magnetic ring made of ferrite material is mounted on the transmission cable to resist the electromagnetic interference. However, the transmission cable has two end connectors that are not coated so that the external interference cannot be isolated efficiently. Thus, the transmission cable is still interrupted by the electromagnetic interference, and produces minor noises that are amplified by the players of the sound reproducing system, thereby decreasing the sound quality. In addition, the anti-magnetic ring and the mesh shielding layer cannot filter the signal interference completely, thereby causing disturbance to the transmission cable.

BRIEF SUMMARY OF THE INVENTION

The primary objective of the present invention is to provide a cable with a demagnetizing layer made of graphene.

In accordance with the present invention, there is provided a cable comprising a transmission cord having two connecting terminals formed on two opposite ends thereof, two connectors respectively mounted on the two connecting terminals of the transmission cord, two end caps mounted on the transmission cord and respectively connected with the two connectors, and at least one demagnetizing layer mounted on the two connectors and received in the two end caps. The transmission cord includes a conducting wire, an insulating layer wrapped around the conducting wire to insulate the conducting wire, and a protective layer wrapped around an outer face of the transmission cord to protect a whole structure of the transmission cord. The conducting wire is made of metallic material. The protective layer is made of insulating material. Each of the two connectors has a first end provided with a connecting portion mounted on mounted on each of the two connecting terminals of the transmission cord and electrically connected with the conducting wire of the transmission cord. Each of the two connectors has a second end provided with a fitting portion electrically coupled to an audio device. Each of the two end caps has a tubular shape. Each of the two end caps is mounted on an outer face of the connecting portion of each of the two connectors, and the connecting portion of each of the two connectors is received in each of the two end caps. The at least one demagnetizing layer is made of graphene material and covers the connecting portion of each of the two connectors.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
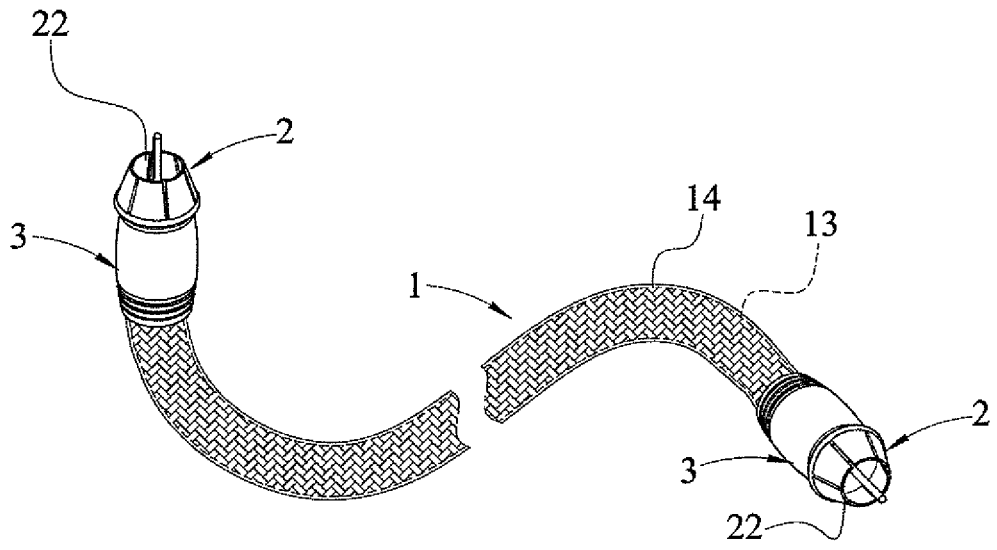
FIG. 1 is a perspective view of a cable in accordance with the preferred embodiment of the present invention.
Figure 2:
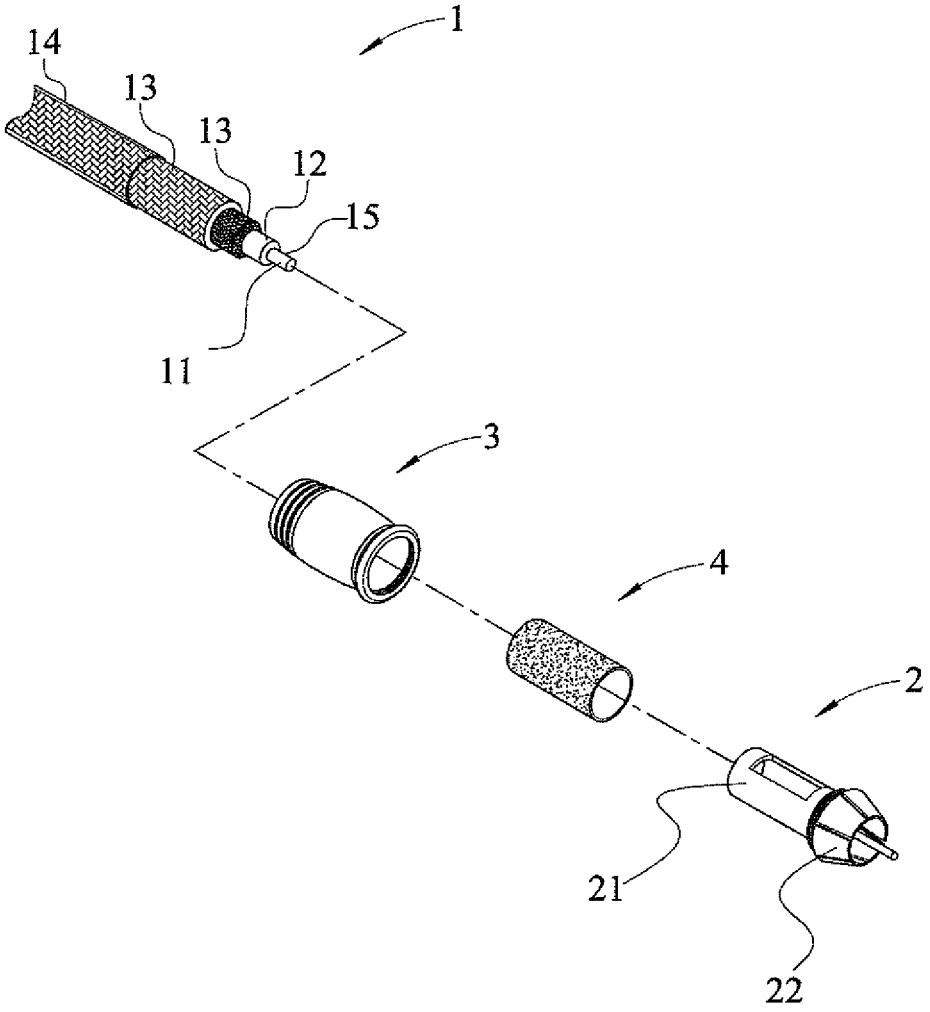
FIG. 2 is an exploded perspective view of the cable in accordance with the preferred embodiment of the present invention.

Referring to the drawings and initially to FIGS. 1 and 2, a cable in accordance with the preferred embodiment of the present invention comprises a transmission cord 1 having two connecting terminals 15 formed on two opposite ends thereof, two connectors 2 respectively mounted on the two connecting terminals 15 of the transmission cord 1, two end caps 3 mounted on the transmission cord 1 and respectively connected with the two connectors 2, and at least one demagnetizing layer 4 mounted on the two connectors 2 and received in the two end caps 3.

The transmission cord 1 functions as an audio signal line or a power supply line. The transmission cord 1 includes a conducting wire 11, an insulating layer 12 wrapped around the conducting wire 11 to insulate the conducting wire 11, and a protective layer 14 wrapped around an outer face of the transmission cord 1 to protect a whole structure of the transmission cord 1. The conducting wire 11 is made of metallic material for transmitting a signal. The protective layer 14 is made of insulating material.

Each of the two connectors 2 has a first end provided with a connecting portion 21 mounted on mounted on each of the two connecting terminals 15 of the transmission cord 1 and electrically connected with the conducting wire 11 of the transmission cord 1. Each of the two connectors 2 has a second end provided with a fitting portion 22 electrically coupled to an audio device, such as a sound or an acoustics for transmitting the signal. Preferably, the fitting portion 22 of each of the two connectors 2 is inserted into a slot of the sound.

Each of the two end caps 3 has a tubular shape. Each of the two end caps 3 is mounted on an outer face of the connecting portion 21 of each of the two connectors 2, and the connecting portion 21 of each of the two connectors 2 is received in each of the two end caps 3. Thus, each of the two end caps 3 protects each of the two connectors 2 and the at least one demagnetizing layer 4.

The at least one demagnetizing layer 4 is made of graphene material and covers the connecting portion 21 of each of the two connectors 2. Thus, the at least one demagnetizing layer 4 is located between each of the two end caps 3 and the connecting portion 21 of each of the two connectors 2.

In the preferred embodiment of the present invention, the at least one demagnetizing layer 4 presents a nanometer dimension.

In the preferred embodiment of the present invention, the transmission cord 1 is made of copper, silver, silver-plated copper, tin-plated copper, gold or an alloy.

In the preferred embodiment of the present invention, the transmission cord 1 is a single-core cord or a stranded cord.

In the preferred embodiment of the present invention, each of the two connectors 2 has a 3.5 connector type, a 6.3 connector type, an RCA terminal type, an XLR balance terminal type, a banana plug type, a corrugated plug type, a Y-shaped plug type or an electric plug type. Thus, each of the two connectors 2 is available for sounds having slots of different specifications.

In the preferred embodiment of the present invention, the transmission cord 1 further includes at least one isolating layer 13 wrapped around an outer face of the insulating layer 12 for isolating an electromagnetic signal interference caused by noises produced by radio waves. The protective layer 14 protects and prevents the at least one isolating layer 13 from being worn out or broken.

In the preferred embodiment of the present invention, the at least one isolating layer 13 is made of an aluminum foil, a hot melt aluminum foil, a tin foil or a mesh weaving metallic thread that is wrapped from inside to outside.

In the preferred embodiment of the present invention, the connecting portion 21 of each of the two connectors 2 is connected with the conducting wire 11 of the transmission cord 1 by soldering.

In the preferred embodiment of the present invention, the transmission cord 1 further includes a steel wire located in the protective layer 14, to reinforce a tensile strength of the transmission cord 1.

In assembly, when the two connectors 2 are respectively mounted on the two connecting terminals 15 of the transmission cord 1, the conducting wire 11 of the transmission cord 1 is exposed outward, so that the at least one isolating layer 13 cannot isolate the electromagnetic signal interference at the two connecting terminals 15 of the transmission cord 1. At this time, the at least one demagnetizing layer 4 covers the two connecting terminals 15 of the transmission cord 1 to provide an isolating effect. It is appreciated that, the at least one demagnetizing layer 4 is made of graphene material to provide a better isolating effect. In addition, the at least one demagnetizing layer 4 presents a nanometer dimension, to produce a volume effect, so that when the diameter of the solid particles is reduced gradually, the chemical property thereof produces variation, such that the at least one demagnetizing layer 4 has a prominent demagnetizing feature and provides a better isolating effect. It is noted that, each of the two end caps 3 is made of a metallic shell that attenuates the electromagnetic waves by reflection to reduce the electromagnetic signal interference caused by the electromagnetic waves.

Besides, the conducting wire 11 is made of different kinds of metallic material, with different transmission features, and with different noise absorbing extents, so that the at least one isolating layer 13 cannot obstruct the noise interferences completely. Thus, the at least one demagnetizing layer 4 has different mounting manners to correspond to the conducting wire 11 made of different kinds of metallic material.

In the preferred embodiment of the present invention, the at least one demagnetizing layer 4 presents a manner of a mounting tube, a sticking manner or a clamping manner.

Figure 3:
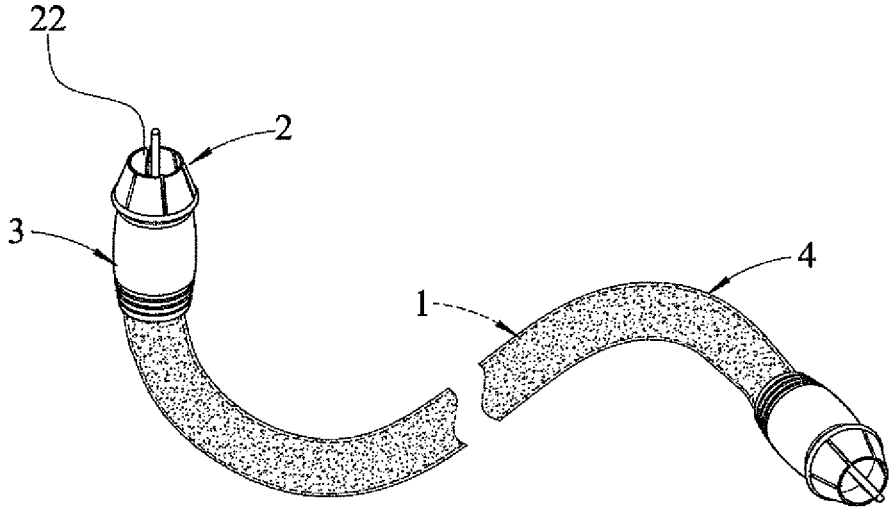
FIG. 3 is a perspective view showing the usage state of the cable in accordance with the first preferred embodiment of the present invention.

As shown in FIG. 3, when the at least one demagnetizing layer 4 presents a manner of a mounting tube, the at least one demagnetizing layer 4 is a mounting tube extending from the connecting portion 21 of each of the two connectors 2 toward the transmission cord 1 and completely covering the protective layer 14 and a connection of the two connecting terminals 15 of the transmission cord 1 and the connecting portion 21 of each of the two connectors 2. Thus, the at least one demagnetizing layer 4 is available, for the transmission cord 1 without the at least one isolating layer 13.

Figure 4:
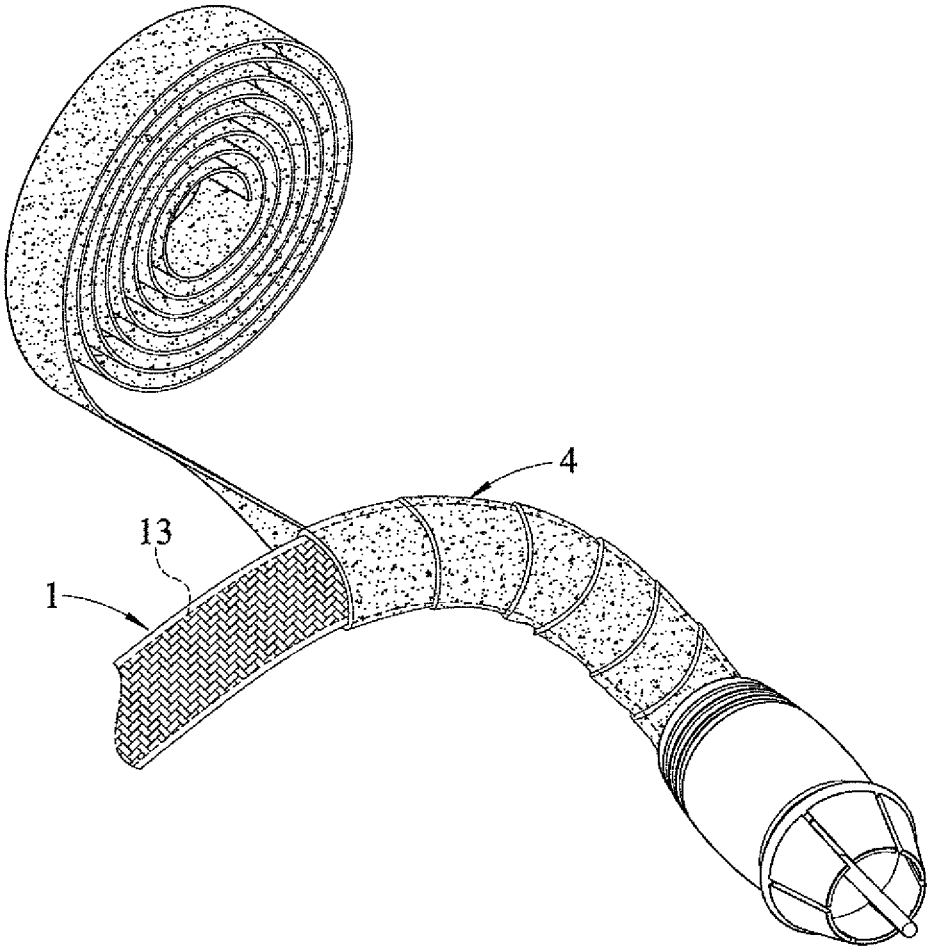
FIG. 4 is a perspective view showing the usage state of the cable in accordance with the second preferred embodiment of the present invention.

As shown in FIG. 4, when the at least one demagnetizing layer 4 presents a sticking manner, the at least one demagnetizing layer 4 is a roll tape wound around the transmission cord 1 successively. Thus, the at least one demagnetizing layer 4 is available for the transmission cord 1 that is old and does not have any demagnetizing effect.

Figure 5:
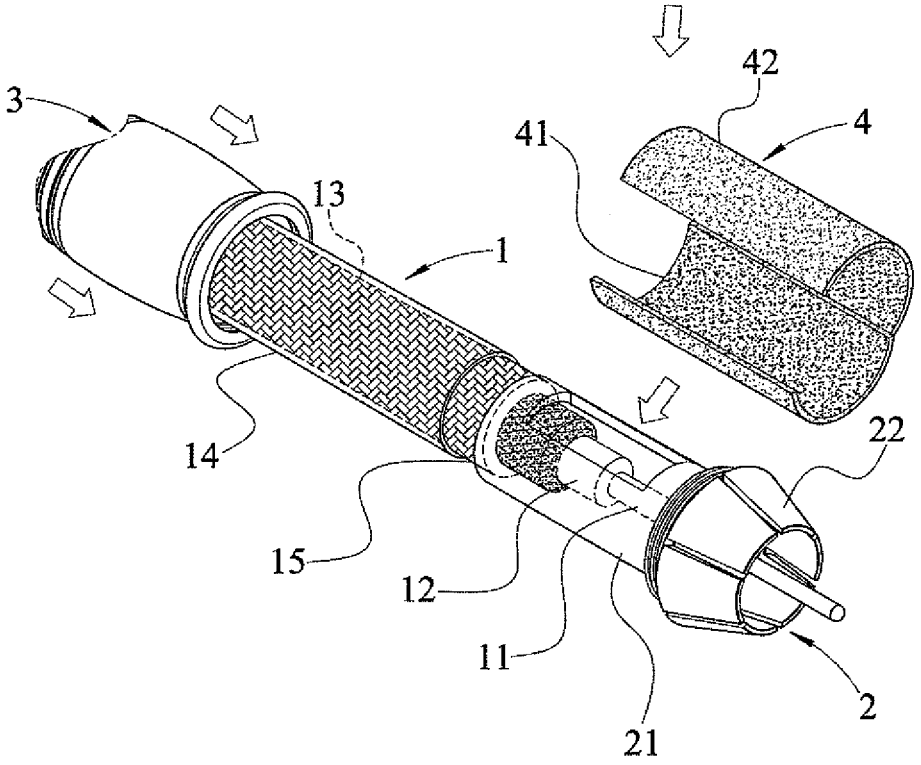
FIG. 5 is a perspective view showing the usage state of the cable in accordance with the third preferred embodiment of the present invention.

As shown in FIG. 5, when the at least one demagnetizing layer 4 presents a clamping manner, the at least one demagnetizing layer 4 is clamped on the two connectors 2 or the transmission cord 1 and includes a shell 41 and a cover 42. The shell 41 and the cover 42 are connected by tenon and mortise engagement. Thus, the at least one demagnetizing layer 4 is adjusted on the transmission cord 1 and is located at a position with the maximum electromagnetic signal interference so as to obstruct the electromagnetic waves efficiently.

Figure 6:
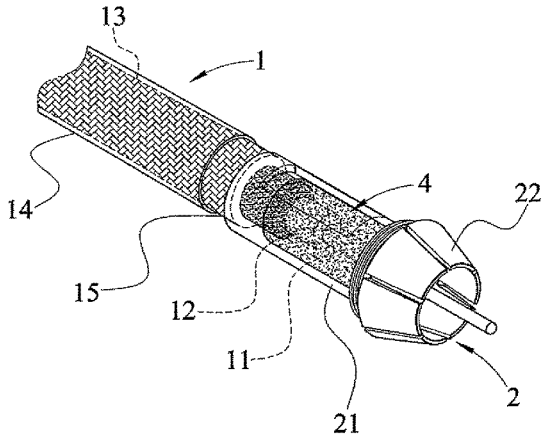
FIG. 6 is a perspective view showing the at least one demagnetizing layer covering the connecting portion of the conducting wire of the transmission cord and the connecting portion of each of the two connectors.

As shown in FIG. 6, the at least one demagnetizing layer 4 is wrapped around an electrical connection of the conducting wire 11 of the transmission cord 1 and the connecting portion 21 of each of the two connectors 2 to enhance the effect for isolating the electromagnetic signal interference.

Accordingly, the at least one demagnetizing layer 4 covers the transmission cord 1 and the connecting portion 21 of each of the two connectors 2 to prevent the noises or the electromagnetic waves of the ambient environment from interfering with or interrupting the signal transmission of the transmission cord 1 and to eliminate the noises, so that the transmission cord 1 produces clean and bright audio signals and transmits the audio signals smoothly and steadily. In addition, each of the two end caps 3 is locked onto the connecting portion 21 of each of the two connectors 2, so that the at least one demagnetizing layer 4 is secured on the connecting portion 21 of each of the two connectors 2 to closely cover the connecting portion 21 of each of the two connectors 2. Further, the at least one demagnetizing layer 4 is made of graphene material to provide an enhanced isolating effect and to obstruct the noises or the electromagnetic waves efficiently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A cable comprising:

a transmission cord having two connecting terminals formed on two opposite ends thereof;

two connectors respectively mounted on the two connecting terminals of the transmission cord;

two end caps mounted on the transmission cord and respectively connected with the two connectors; and at least one demagnetizing layer mounted on the two connectors and received in the two end caps;

wherein:

the transmission cord includes:

a conducting wire;

an insulating layer wrapped around the conducting wire to insulate the conducting wire; and a protective layer wrapped around an outer face of the transmission cord to protect a whole structure of the transmission cord;

the conducting wire is made of metallic material;

the protective layer is made of insulating material;

each of the two connectors has a first end provided with a connecting portion mounted on mounted on each of the two connecting terminals of the transmission cord and electrically connected with the conducting wire of the transmission cord;

each of the two connectors has a second end provided with a fitting portion electrically coupled to an audio device;

each of the two end caps has a tubular shape;

each of the two end caps is mounted on an outer face of the connecting portion of each of the two connectors;

the connecting portion of each of the two connectors is received in each of the two end caps; and the at least one demagnetizing layer is made of graphene material and covers the connecting portion of each of the two connectors.

2. The cable of claim 1, wherein the at least one demagnetizing layer presents a nanometer dimension.

3. The cable of claim 1, wherein the at least one demagnetizing layer presents a manner of a mounting tube, a sticking manner or a clamping manner.

4. The cable of claim 3, wherein when the at least one demagnetizing layer presents a manner of a mounting tube, the at least one demagnetizing layer is a mounting tube extending from the connecting portion of each of the two connectors toward the transmission cord and completely covering the protective layer and a connection of the two connecting terminals of the transmission cord and the connecting portion of each of the two connectors.

5. The cable of claim 3, wherein when the at least one demagnetizing layer presents a sticking manner, the at least one demagnetizing layer is a roll tape wound around the transmission cord.

6. The cable of claim 3, wherein the when the at least one demagnetizing layer presents a clamping manner, the at least one demagnetizing layer is clamped on the two connectors or the transmission cord and includes a shell and a cover.

7. The cable of claim 1, wherein the transmission cord is made of copper, silver, silver-plated copper, tin-plated copper, gold or an alloy.

8. The cable of claim 1, wherein the transmission cord is a single-core cord or a stranded cord.

9. The cable of claim 1, wherein each of the two connectors has a 3.5 connector type, a 6.3 connector type, an RCA terminal type, an XLR balance terminal type, a banana plug type, a corrugated plug type, a Y-shaped plug type or an electric plug type.

10. The cable of claim 1, wherein the transmission cord further includes at least one isolating layer wrapped around an outer face of the insulating layer for isolating an electromagnetic signal interference.

11. The cable of claim 1, wherein the at least one isolating layer is made of an aluminum foil, a hot melt aluminum foil, a tin foil or a mesh weaving metallic thread that is wrapped from inside to outside.

12. The cable of claim 1, wherein the connecting portion of each of the two connectors is connected with the conducting wire of the transmission cord by soldering.

13. The cable of claim 1, wherein the at least one demagnetizing layer is wrapped around an electrical connection of the conducting wire of the transmission cord and the connecting portion of each of the two connectors.

14. The cable of claim 1, wherein the transmission cord further includes a steel wire located in the protective layer to reinforce a tensile strength of the transmission cord.

* * * * *